US009173048B2

(12) United States Patent
McGrath

(10) Patent No.: US 9,173,048 B2
(45) Date of Patent: Oct. 27, 2015

(54) METHOD AND SYSTEM FOR GENERATING A MATRIX-ENCODED TWO-CHANNEL AUDIO SIGNAL

(75) Inventor: David S. McGrath, Rose Bay (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 126 days.

(21) Appl. No.: 14/239,510

(22) PCT Filed: Aug. 14, 2012

(86) PCT No.: PCT/US2012/050701
§ 371 (c)(1),
(2), (4) Date: Feb. 18, 2014

(87) PCT Pub. No.: WO2013/028393
PCT Pub. Date: Feb. 28, 2013

(65) Prior Publication Data

US 2014/0219460 A1 Aug. 7, 2014

Related U.S. Application Data

(60) Provisional application No. 61/526,415, filed on Aug. 23, 2011.

(51) Int. Cl.
*H04S 3/02* (2006.01)

(52) U.S. Cl.
CPC ..... *H04S 3/02* (2013.01)

(58) Field of Classification Search
None
See application file for complete search history.

(56) References Cited

U.S. PATENT DOCUMENTS

| | | | |
|---|---|---|---|
| 4,042,779 | A | 8/1977 | Craven |
| 4,262,170 | A | 4/1981 | Bauer |
| 4,392,019 | A | 7/1983 | Halliday |

(Continued)

FOREIGN PATENT DOCUMENTS

| | | |
|---|---|---|
| EP | 1737271 | 12/2006 |
| GB | 2067057 | 7/1981 |
| JP | 4-29500 | 1/1992 |
| WO | 00/47018 | 8/2000 |

(Continued)

OTHER PUBLICATIONS

Gerzon, Michael A "Ambisonics in Multichannel Broadcasting and Video", Preprint 2034 of the 74th Audio Engineering Society Convention, New York, Oct. 1983.

(Continued)

*Primary Examiner* — Paul Huber

(57) ABSTRACT

In some embodiments, a method for generating a matrix-encoded two-channel audio signal in response to a horizontal B-format signal by performing a mixing operation. In other embodiments, a method for generating a matrix-encoded two-channel audio signal, including steps of generating microphone output signals (by capturing sound with a microphone array), and performing a mixing operation on the microphone output signals, where the mixing operation is equivalent to generating a horizontal B-format signal in response to the microphone output signals, and generating the matrix-encoded two-channel audio signal in response to the horizontal B-format signal. The microphone array is typically a small array of cardiod microphones (e.g., an array consisting of three cardiod microphones). Other aspects include systems (e.g., encoders) programmed or otherwise configured to perform any embodiment of the method for generating a matrix-encoded two-channel audio signal.

20 Claims, 6 Drawing Sheets

(56) References Cited

U.S. PATENT DOCUMENTS

| | | | |
|---|---|---|---|
| 6,041,127 | A | 3/2000 | Elko |
| 7,133,530 | B2 | 11/2006 | Poletti |
| 8,103,006 | B2 | 1/2012 | McGrath |
| 2007/0147634 | A1 | 6/2007 | Chu |
| 2008/0170718 | A1 | 7/2008 | Faller |
| 2009/0190776 | A1 | 7/2009 | Reining |
| 2010/0142732 | A1 | 6/2010 | Craven |
| 2010/0169102 | A1 | 7/2010 | Samsudin |

FOREIGN PATENT DOCUMENTS

| | | |
|---|---|---|
| WO | 2011/076290 | 6/2011 |

OTHER PUBLICATIONS

Cheng, B. et al "A Spatial Squeezing Approach to Ambisonic Audio Compression" Acoustics, Speech and Signal Processing, International Conference on IEEE, Piscataway, NJ, USA, Mar. 31, 2008, pp. 369-372.

Jean-Marc Jot et al. "Spatial Audio Scene Coding in a Universal Two-Channel 3-D Stereo Format" AES Convention 123, Oct. 2007.

FIG. 3
(PRIOR ART)

$$\begin{bmatrix} W \\ X \\ Y \end{bmatrix} = \begin{bmatrix} \frac{2}{3} & \frac{2}{3} & \frac{2}{3} \\ \frac{2}{3} & \frac{2}{3} & -\frac{4}{3} \\ \frac{2}{\sqrt{3}} & -\frac{2}{\sqrt{3}} & 0 \end{bmatrix} \times \begin{bmatrix} L \\ R \\ S \end{bmatrix}$$

FIG. 4

$$\begin{bmatrix} Lt \\ Rt \end{bmatrix} = F \times \begin{bmatrix} L \\ R \\ S \end{bmatrix}$$

$$\text{where, } F = M \times \begin{bmatrix} \frac{2}{3} & \frac{2}{3} & \frac{2}{3} \\ \frac{2}{3} & \frac{2}{3} & -\frac{4}{3} \\ \frac{2}{\sqrt{3}} & -\frac{2}{\sqrt{3}} & 0 \end{bmatrix}$$

$$= \begin{bmatrix} \frac{2+(1+j)\sqrt{3}}{3\sqrt{2}} & \frac{2-(1+j)\sqrt{3}}{3\sqrt{2}} & \frac{-1+3j}{3\sqrt{2}} \\ \frac{2-(1-j)\sqrt{3}}{3\sqrt{2}} & \frac{2+(1-j)\sqrt{3}}{3\sqrt{2}} & \frac{-1-3j}{3\sqrt{2}} \end{bmatrix}$$

FIG. 5
(PRIOR ART)

$$\begin{bmatrix} L \\ C \\ R \\ S \end{bmatrix} = \begin{bmatrix} \frac{1}{4} & 0 & \frac{1}{2} \\ \frac{1}{4} & \frac{1}{2} & 0 \\ \frac{1}{4} & 0 & -\frac{1}{2} \\ \frac{1}{4} & -\frac{1}{2} & 0 \end{bmatrix} \times \begin{bmatrix} W \\ X \\ Y \end{bmatrix}$$

FIG. 6
(PRIOR ART)

$$\begin{bmatrix} Lt \\ Rt \end{bmatrix} = \begin{bmatrix} 1 & \frac{1}{\sqrt{2}} & 0 & \frac{j}{\sqrt{2}} \\ 0 & \frac{1}{\sqrt{2}} & 1 & -\frac{j}{\sqrt{2}} \end{bmatrix} \times \begin{bmatrix} L \\ C \\ R \\ S \end{bmatrix}$$

FIG. 7

$$\begin{bmatrix} Lt \\ Rt \end{bmatrix} = \begin{bmatrix} \frac{2+(1+j)\sqrt{2}}{8} & \frac{(1-j)\sqrt{2}}{4} & \frac{1}{2} \\ \frac{2+(1-j)\sqrt{2}}{8} & \frac{(1+j)\sqrt{2}}{4} & -\frac{1}{2} \end{bmatrix} \times \begin{bmatrix} W \\ X \\ Y \end{bmatrix}$$

FIG. 8
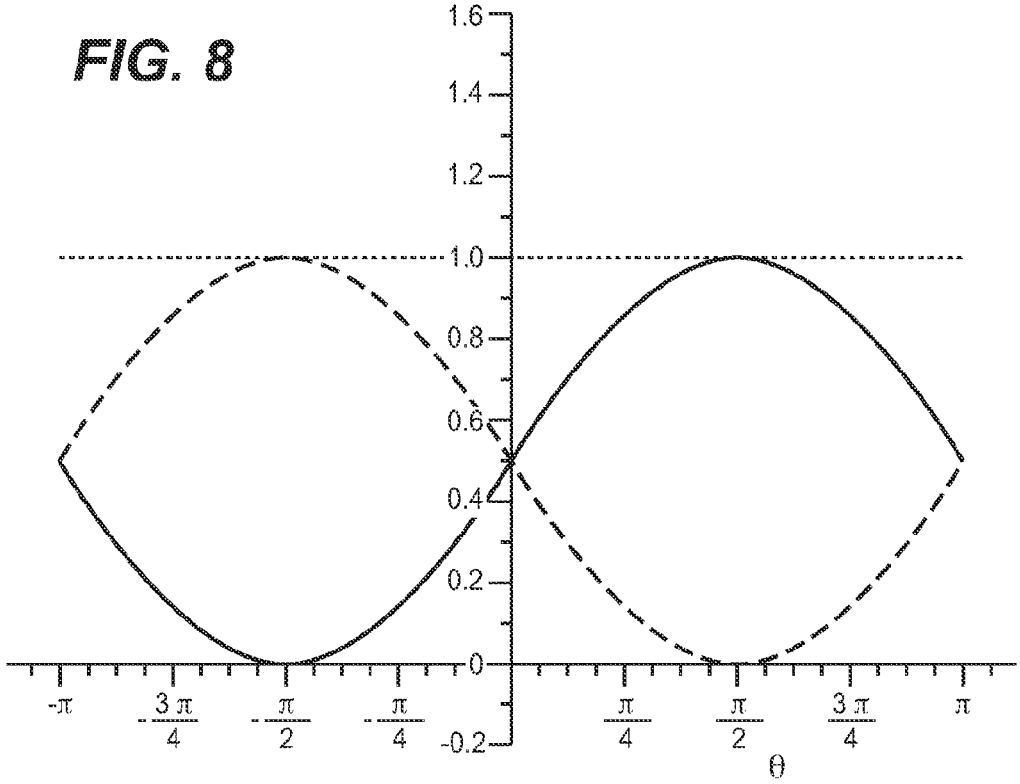
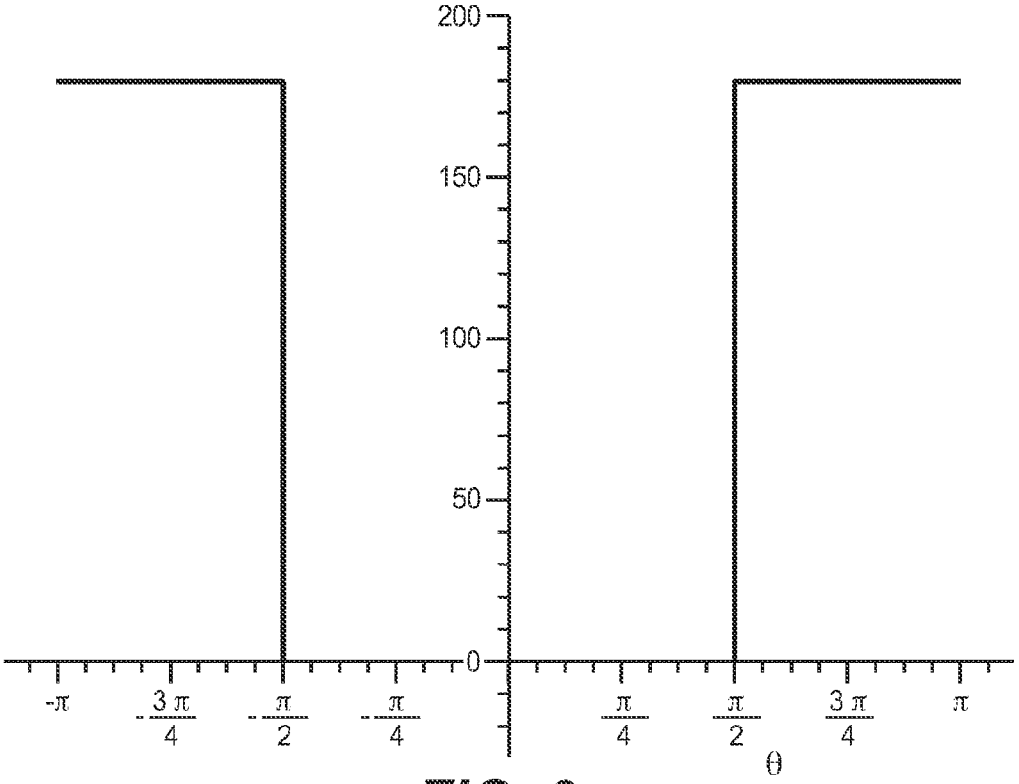
FIG. 9

FIG. 10
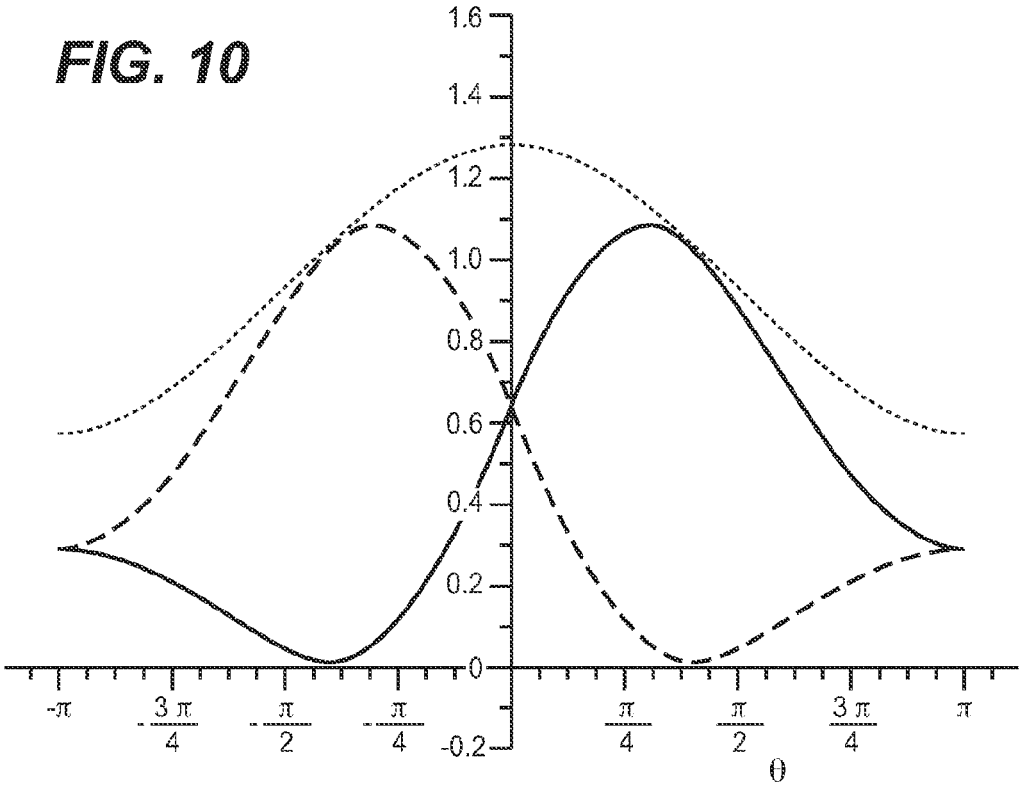
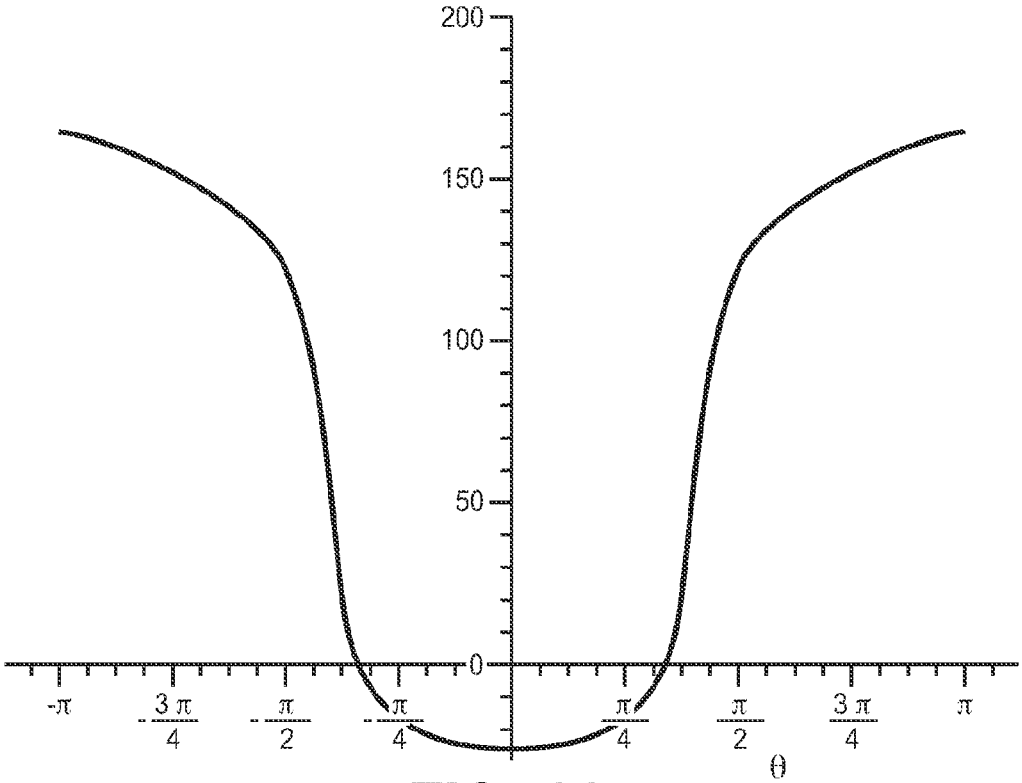
FIG. 11

METHOD AND SYSTEM FOR GENERATING A MATRIX-ENCODED TWO-CHANNEL AUDIO SIGNAL

CROSS-REFERENCE TO RELATED APPLICATIONS

This application claims priority to U.S. Provisional Patent Application No. 61/526,415 filed 23 Aug. 2011, which is hereby incorporated by reference in its entirety.

BACKGROUND OF THE INVENTION

1. Field of the Invention

The invention relates to methods and systems for generating a matrix-encoded two-channel audio signal, in response to a horizontal B-format signal, or in response to the output signals of a microphone array.

2. Background of the Invention

Throughout this disclosure, including in the claims, the term "render" denotes the process of converting an audio signal (e.g., a multi-channel audio signal) into one or more speaker feeds (where each speaker feed is an audio signal to be applied directly to a loudspeaker or to an amplifier and loudspeaker in series), or the process of converting an audio signal into one or more speaker feeds and converting the speaker feed(s) to sound using one or more loudspeakers. In the latter case, the rendering is sometimes referred to herein as rendering "by" the loudspeaker(s).

Throughout this disclosure, including in the claims, the terms "speaker" and "loudspeaker" are used synonymously to denote any sound-emitting transducer. This definition includes loudspeakers implemented as multiple transducers (e.g., woofer and tweeter).

Throughout this disclosure, including in the claims, the expression performing an operation "on" signals or data (e.g., filtering, scaling, or transforming the signals or data) is used in a broad sense to denote performing the operation directly on the signals or data, or on processed versions of the signals or data (e.g., on versions of the signals that have undergone preliminary filtering prior to performance of the operation thereon).

Throughout this disclosure including in the claims, the expression "system" is used in a broad sense to denote a device, system, or subsystem. For example, a subsystem that implements an encoder may be referred to as an encoder system (or an encoder), and a system including such a subsystem (e.g., a system that generates X output signals in response to multiple inputs, in which the subsystem generates M of the inputs and the other X-M inputs are received from an external source) may also be referred to as an encoder system (or an encoder).

Throughout this disclosure including in the claims, the verb "includes" is used in a broad sense to denote "is or includes," and other forms of the verb "include" are used in the same broad sense. For example, the expression "a filter which includes a feedback filter" (or the expression "a filter including a feedback filter") herein denotes either a filter which is a feedback filter (i.e., does not include a feedforward filter), or filter which includes a feedback filter (and at least one other filter).

A matrix-encoded two-channel audio signal can be rendered (typically, including by performing a decoding operation thereon) by a speaker array to produce a multi-channel sound field. For example, one type of matrix-encoded two-channel audio signal can be decoded to determine N (where N is greater than two) audio channels for rendering by a speaker array (e.g., an array of N speakers).

Matrix encoding is a method for mixing one or more (e.g., two, three, four, or five) source audio signals into a pair of encoded audio signals, such that each source signal is mixed into the encoded signals according to directional encoding rules. The directional encoding rules operate on the assumption that there is a source azimuth angle θ associated with each source audio signal, where θ is defined as in FIG. 1. Specifically, the source shown in FIG. 1 is the source of an audio signal having the time-varying audio waveform "SourceSig" which is received by a microphone array (e.g., a single microphone) or listener at the origin of the indicated X-Y coordinate system. In FIG. 1, positive values along the X-axis correspond to positions in front of the listener (or microphone array), and azimuth θ is measured anticlockwise from the X-axis.

The directional rules that must be satisfied to generate a matrix-encoded two-channel audio signal can be expressed in terms of a simple set of instructions as follows:

1. The matrix-encoded audio signals are referred to as left channel signal Lt and right channel signal Rt (a matrix-encoded pair of audio signals). To generate a matrix-encoded audio signal indicative of a source audio signal having the time-varying audio waveform, SourceSig, and source azimuth, θ, the source audio signal should be mixed into the Lt and Rt signals with a pair of encoder gains ($G_{Lt}$, and $G_{Rt}$, which are functions of θ), such that:

$$Lt=G_{Lt}(\theta)\times\text{SourceSig}, \tag{1}$$

$$Rt=G_{Rt}(\theta)\times\text{SourceSig, and} \tag{2}$$

$$|G_{Lt}|^2+|G_{Rt}|^2=1. \tag{3}$$

Equation (3) is sometimes referred to as the constant power rule. Note that, in keeping with common nomenclature, the gains ($G_{Lt}$ and $G_{Rt}$) may be complex valued, where the argument of the complex gain corresponds to a phase-shift in the mixing operation;

2. Any source audio signal that has a source azimuth of 0° (θ=0), corresponding to the centre-front channel of a multi-channel audio stream, for example, should be encoded into the Lt and Rt signals with encoder gains satisfying $G_{Lt}=G_{Rt}$;

3. Any source audio signal that has a source azimuth of 90° (θ=π/2), corresponding to the left channel of a multi-channel audio stream, for example, should be encoded into the Lt and Rt signals with encoder gains satisfying $|G_{Lt}|=1$ and $G_{Rt}=0$;

4. Any source audio signal that has a source azimuth of −90° (θ=−π/2), corresponding to the right channel of a multi-channel audio stream, for example, should be encoded into the Lt and Rt signals with encoder gains satisfying $G_{Lt}=0$ and $|G_{Rt}|=1$; and 5. Any source audio signal that has a source azimuth of 180° (θ=π), corresponding to the centre-rear channel of a multi-channel audio stream, for example, should be encoded into the Lt and Rt signals with encoder gains satisfying $G_{Lt}=G_{Rt}$.

It can be shown that the above rules can be satisfied by using gain values (each a function of source azimuth θ) defined as follows:

$$G_{Lt}=e^{j\Phi(\theta)}\times\cos(\theta/2-\pi/4), \text{ and} \tag{4}$$

$$G_{Rt}=e^{j\Phi(\theta)}\times\cos(\theta/2+\pi/4), \tag{5}$$

where Φ(θ) is an arbitrary real valued function defined over the interval $-\pi<\theta\leq\pi$.

The function Φ(θ) effectively applies an azimuth-dependent phase shift to the Lt and Rt signals equally. Note that a Matrix Decoder operates by examining the relative amplitude and phase of the Lt and Rt signals, but has no way of detecting a bulk phase shift that has been applied equally to both Lt and Rt. Hence, the general case for matrix-encoded signals includes this $\Phi(\theta)$ term.

Another audio signal format is the horizontal B-format. Similar to the way that matrix-encoded signals may be defined in terms of azimuth-dependent gain functions $G_{Lt}(\theta)$ and $G_{Rt}(\theta)$ (and a source signal waveform, SourceSig), a horizontal B-format signal (indicative of a source audio signal having waveform, SourceSig, and azimuth $\theta$) is defined herein as being composed of three audio signals, W, X and Y, as follows:

$$W=\text{SourceSig}, \tag{6}$$

$$X=\cos\theta\times\text{SourceSig}, \tag{7}$$

$$Y=\sin\theta\times\text{SourceSig}. \tag{8}$$

Some authors define the W signal with a reduced amplitude, as $$W=\frac{1}{\sqrt{2}}\times SourceSig,$$

but that definition is not used herein. It will be apparent to those of ordinary skill that the present invention applies to B-format signals with alternative scaling of their audio signal components, without loss of generality.

A variety of methods are known for recording an acoustic performance (or other acoustic event) in the form of a B-format signal.

Gerzon proposed (in M. A. Gerzon, "Ambisonics in Multichannel Broadcasting and Video," Preprint 2034 of the 74th Audio Engineering Society Convention, New York, October 1983) a method for mixing the W, X, and Y channels of a horizontal B-format signal into two channels (i.e., a UHJ format stereo signal; not a matrix-encoded stereo signal) to enable more convenient handling in a transmission and playback environment. The UHJ format stereo signal comprised two signals ($\Sigma$ and $\Delta$) which could be converted to UHJ format L and R stereo channels as follows:

$$\Sigma=0.9397\times W+0.2624\times X$$

$$\Delta=j\times(-0.3420\times W+0.7211\times X)+0.9269\times Y$$

$$L=\frac{\Sigma+\Delta}{2}$$

$$R=\frac{\Sigma-\Delta}{2}.$$

Note that the above UHJ encoding equations for $\Sigma$, $\Delta$, L, and R are based on the assumption that the W, X, and Y signals are scaled according to above equations (6), (7), and (8); not with application of a $$\frac{1}{\sqrt{2}}$$

scaling factor to W].

The UHJ encoding equations set forth above may be written in matrix form as:

$$\begin{bmatrix} L \\ R \end{bmatrix}=\begin{bmatrix} 0.4698-0.1710j & 0.1213+0.3605j & 0.4634 \\ 0.4698+0.1710j & 0.1213-0.3605j & -0.4634 \end{bmatrix}\times\begin{bmatrix} W \\ X \\ Y \end{bmatrix} \tag{9}$$

Gerzon's method for mixing the three channels of a horizontal B-format signal into a stereo pair is intended to provide a reasonable stereo listening experience, as well as to provide some ability to regenerate an approximate version of the original W, X, and Y signals from the UHJ format L and R stereo signals. However, the stereo UHJ format has significant disadvantages:

UHJ encoding (per equation (9) does not encode an original source signal (with azimuth $\theta$) with power independent of $\theta$. Rather, the power of the UHJ format L and R signal pair (or the corresponding $\Sigma$ and $\Delta$ signal pair) depends on the azimuth $\theta$ of the source signal. Sounds from the front will be encoded (by equation (9)) with greater amplitude than sounds from the rear. Indeed, it was the design intention of UHJ encoding to give greater prominence to frontal signals; and an original source signal with azimuth equal to zero (i.e., a front-center source signal) is encoded into the UHJ format L and R channels with a phase shift between the channels (i.e., the UHJ format L and R channels generated in response to a front-center source each have form kW+j(mW), where k and m are nonzero coefficients). This means that a clear phantom-center image will not be formed by the stereo UHJ signal.

Typical embodiments of the present invention generate a matrix-encoded two-channel (stereo) signal in response to in response to a horizontal B-format signal (or in response to the output signals of a microphone array). These matrix-encoded stereo signals are useful for many purposes. For example, matrix-encoded two-channel signals generated by typical embodiments of the invention are useful as input to decoders which implement Dolby ProLogic II decoding. Such decoders are in widespread use throughout the world.

Also, until the present invention, it had not been known how to use the outputs of microphone arrays (e.g., simple arrangements of simple microphones, such as for example, cardiod microphones with 1st-order directivity patterns) to generate matrix-encoded signals via a simple linear mixing process. Matrix-encoded two-channel signals are generated by some embodiments of the invention by capturing an acoustic event with any of a variety of commonly available microphone arrangements (e.g., B-format microphones) and encoding the resulting microphone outputs into a matrix-encoded signal pair.

BRIEF DESCRIPTION OF THE INVENTION

In a class of embodiments, the invention is a method for generating a matrix-encoded two-channel (stereo) audio signal, Lt, Rt, in response to a horizontal B-format signal comprising signals W=SourceSig, X=cos $\theta$×SourceSig, and Y=sin $\theta$×SourceSig, where SourceSig is the waveform of a source audio signal and $\theta$ is the azimuth of the source audio signal, said method including a step of:

(a) performing on the horizontal B-format signal a mixing operation having form $$\begin{bmatrix} Lt \\ Rt \end{bmatrix}=S\times\begin{bmatrix} W \\ X \\ Y \end{bmatrix},$$

where $S=e^{j\Psi}\times T$, $\Psi$ is a real phase shift, and T is a 2×3 matrix.

In any embodiment of the invention, the expression "mixing operation having" an indicated "form" denotes either that the mixing operation is identical to the operation having the indicated form, or that the mixing operation differs from the operation having the indicated form by presence of a scaling factor. For example, one example of a mixing operation having "form" K=L×M, where K and M are vectors and L is a matrix, is the operation K=(sL)×M, where s is a scaling factor.

In the above-noted class of embodiments, the matrix T is preferably selected from the group consisting of M and $M_c=\overline{M}$, where $$M=\begin{bmatrix}\frac{1+j}{2\sqrt{2}} & \frac{1-j}{2\sqrt{2}} & \frac{1+j}{2\sqrt{2}}\\ \frac{1-j}{2\sqrt{2}} & \frac{1+j}{2\sqrt{2}} & \frac{-1+j}{2\sqrt{2}}\end{bmatrix}\text{ and}$$

$$M_c=\overline{M}=\begin{bmatrix}\frac{1-j}{2\sqrt{2}} & \frac{1+j}{2\sqrt{2}} & \frac{1-j}{2\sqrt{2}}\\ \frac{1+j}{2\sqrt{2}} & \frac{1-j}{2\sqrt{2}} & \frac{-1-j}{2\sqrt{2}}\end{bmatrix}.$$

In typical embodiments in this class, the source audio signal has a frequency domain representation including at least one frequency component, each said frequency component having a different frequency, ω, the horizontal B-format signal has complex frequency components W(ω), X(ω), and Y(ω) for each frequency component of the source audio signal, and step (a) includes the step of:

for each said frequency component of the source audio signal, generating complex frequency components, Lt(ω), Rt(ω), of the matrix-encoded two-channel audio signal in response to the frequency components W(ω), X(ω), and Y(ω), of the horizontal B-format signal by performing a mixing operation having form $$\begin{bmatrix}Lt(\omega)\\ Rt(\omega)\end{bmatrix}=S(\omega)\times\begin{bmatrix}W(\omega)\\ X(\omega)\\ Y(\omega)\end{bmatrix},$$

where $S(\omega)=e^{j\Psi(\omega)}\times T$, and Ψ(ω) is a real phase shift whose value depends on the frequency, ω. Preferably, the 2×3 matrix T is selected is selected from the group consisting of M and $M_c=\overline{M}$, where $$M=\begin{bmatrix}\frac{1+j}{2\sqrt{2}} & \frac{1-j}{2\sqrt{2}} & \frac{1+j}{2\sqrt{2}}\\ \frac{1-j}{2\sqrt{2}} & \frac{1+j}{2\sqrt{2}} & \frac{-1+j}{2\sqrt{2}}\end{bmatrix}\text{ and}$$

$$M_c=\overline{M}=\begin{bmatrix}\frac{1-j}{2\sqrt{2}} & \frac{1+j}{2\sqrt{2}} & \frac{1-j}{2\sqrt{2}}\\ \frac{1+j}{2\sqrt{2}} & \frac{1-j}{2\sqrt{2}} & \frac{-1-j}{2\sqrt{2}}\end{bmatrix}.$$

Typically, each set of three frequency components W(ω), X(ω), and Y(ω) of the horizontal B-format signal is indicative of a frequency component, SourceSig(ω), of the source audio signal, and each said set of three frequency components W(ω), X(ω), and Y(ω) is W(ω)=SourceSig(ω), X(ω)=cos θ×SourceSig(ω), and Y(ω)=sin θ×SourceSig(ω). Also typically, the matrix-encoded two-channel audio signal Lt, Rt, is a time domain, matrix-encoded two-channel audio signal, and the method also includes a step of:

(b) performing a frequency-to-time domain transform on the frequency components Lt(ω), Rt(ω) generated in step (a) to determine said time domain, matrix-encoded two-channel audio signal.

In embodiments in which the horizontal B-format signal is indicative of a source audio signal having at least one frequency component, each frequency component having a different frequency, ω, and the horizontal B-format signal has frequency components W(ω), X(ω), and Y(ω) for each frequency component of the source audio signal, each frequency ω is typically measured in radians per second, the frequency components W(ω), X(ω), and Y(ω) are typically defined for only positive frequencies, and the complex gain values included in the matrix S(ω) are gains that apply to positive frequencies (ω>0). It is also within the scope of the invention for the frequency components W(ω), X(ω), and Y(ω) to be defined for positive and negative frequencies, and to apply in step (a) the matrix $S(\omega)=e^{j\Psi(\omega)}\times T$ to the components W(ω), X(ω), and Y(ω) having positive frequency, and to apply in step (a) the complex conjugate of said matrix S(ω) to the components W(ω), X(ω), and Y(ω) having negative frequency.

In another class of embodiments, the invention is a method for generating a matrix-encoded two-channel (stereo) audio signal, including the steps of generating microphone output signals (by capturing sound with a microphone array), and performing a mixing operation on the microphone output signals, wherein the mixing operation is equivalent to (e.g., comprises the steps of) generating a horizontal B-format signal in response to the microphone output signals and generating the matrix-encoded two-channel audio signal, Lt, Rt, in response to the horizontal B-format signal in accordance with any embodiment of the inventive method. The microphone array is typically a small array of cardioid microphones (e.g., an array consisting of three cardiod microphones). In one subclass of embodiments in this class, the mixing operation includes the steps of: generating the horizontal B-format signal in response to the microphone output signals; and generating the matrix-encoded two-channel audio signal, Lt, Rt, in response to the horizontal B-format signal in accordance with any embodiment of the inventive method.

In a second subclass of embodiments in this class, the microphone output signals are a set of n microphone signals, M1, . . . , Mn, and the mixing operation has form $$\begin{bmatrix}Lt\\ Rt\end{bmatrix}=S'\times\begin{bmatrix}M1\\ \vdots\\ Mn\end{bmatrix},$$

where $S'=e^{j\Psi}\times T'$, Ψ is a real phase shift, and T' is a 2×n matrix.

In some embodiments in the second subclass, n=3, the microphone output signals are a left channel signal, L (having a frequency domain representation including at least one frequency component, L(ω), where ω denotes frequency), a right channel signal, R (having a frequency domain representation including at least one frequency component, R(ω)), and a surround (rear) channel signal, S (having a frequency domain representation including at least one frequency component, S(ω)), the matrix-encoded two-channel audio signal, Lt, Rt, has a frequency domain representation including at least one pair of frequency components, Lt(ω), Rt(ω), and the step of generating the matrix-encoded two-channel audio signal, Lt, Rt, includes a step of:

(a) generating the frequency components Lt(ω), Rt(ω) in response to the frequency components L(ω), R(ω), and S(ω), by performing a mixing operation having form $$\begin{bmatrix} Lt(\omega) \\ Rt(\omega) \end{bmatrix} = S'(\omega) \times \begin{bmatrix} L(\omega) \\ R(\omega) \\ S(\omega) \end{bmatrix},$$

where $S'(\omega)=e^{j\Psi(\omega)}\times T'$, $\Psi(\omega)$ is a real phase shift whose value depends on the frequency, ω, and T' is a 2×3 matrix. Preferably, the matrix T' is selected from the group consisting of $$M \times \begin{bmatrix} 2/3 & 2/3 & 2/3 \\ 2/3 & 2/3 & -4/3 \\ 2/\sqrt{3} & -2\sqrt{3} & 0 \end{bmatrix} \text{ and}$$

$$M_c \times \begin{bmatrix} 2/3 & 2/3 & 2/3 \\ 2/3 & 2/3 & -4/3 \\ 2/\sqrt{3} & -2\sqrt{3} & 0 \end{bmatrix},$$

$$\text{where } M = \begin{bmatrix} \frac{1+j}{2\sqrt{2}} & \frac{1-j}{2\sqrt{2}} & \frac{1+j}{2\sqrt{2}} \\ \frac{1-j}{2\sqrt{2}} & \frac{1+j}{2\sqrt{2}} & \frac{-1+j}{2\sqrt{2}} \end{bmatrix} \text{ and}$$

$$M_c = \overline{M} = \begin{bmatrix} \frac{1-j}{2\sqrt{2}} & \frac{1+j}{2\sqrt{2}} & \frac{1-j}{2\sqrt{2}} \\ \frac{1+j}{2\sqrt{2}} & \frac{1-j}{2\sqrt{2}} & \frac{-1-j}{2\sqrt{2}} \end{bmatrix}.$$

Typically, the matrix-encoded two-channel audio signal Lt, Rt, is a time domain, matrix-encoded two-channel audio signal, and the step of generating the matrix-encoded two-channel audio signal, Lt, Rt, also includes a step of:

(b) performing a frequency-to-time domain transform on the frequency components Lt(ω), Rt(ω) generated in step (a) to determine the time domain, matrix-encoded two-channel audio signal.

Aspects of the invention include a system (e.g., an encoder) configured (e.g., programmed) to perform any embodiment of the inventive method, and a computer readable medium (e.g., a disc) which stores code for programming a processor or other system to perform any embodiment of the inventive method.

BRIEF DESCRIPTION OF THE DRAWINGS

FIG. 3 is an equation defining a conventional transform.

FIG. 4 is a set of equations that defines a transform implemented in accordance with an embodiment of the invention.

FIG. 5 is an equation defining a conventional transform.

FIG. 6 is an equation defining a conventional transform.

FIG. 7 is an equation which defines a combination of the FIG. 5 and FIG. 6 transforms.

FIG. 8 is a graph of the power of the Lt signal generated by the method of equation (10) as a function of azimuth θ (the solid curve), the power of the Rt signal generated by this method as a function of azimuth θ (the dashed curve), and the total power of these Lt and Rt signals as a function of azimuth θ (the dotted curve).

FIG. 9 is a graph of the phase difference between the Lt and Rt signals of FIG. 8 as a function of the azimuth θ.

FIG. 10 is a graph of the power of the Lt signal generated by the conventional method of equation (24) as a function of azimuth θ (the solid curve), the power of the Rt signal generated by this method as a function of azimuth θ (the dashed curve), and the total power of these Lt and Rt signals as a function of azimuth θ (the dotted curve).

FIG. 11 is a graph of the phase difference between the Lt and Rt signals of FIG. 10 as a function of the azimuth θ.

DETAILED DESCRIPTION OF THE PREFERRED EMBODIMENTS

Figure 1:
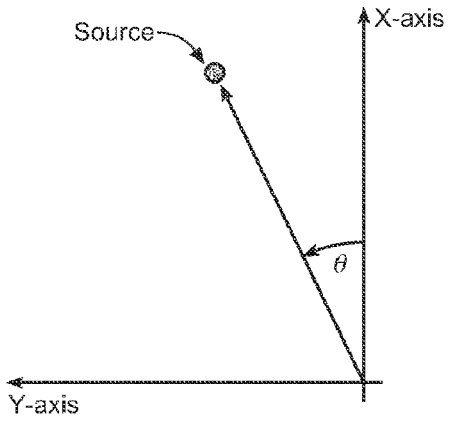
FIG. 1 is a diagram of an audio signal source located as shown in an X-Y coordinate system. The audio signal emitted from the source is received by a microphone array or listener at the origin of the X-Y coordinate system, and the source is at the indicated azimuth θ relative to the origin of the X-Y coordinate system.

Many embodiments of the present invention are technologically possible. It will be apparent to those of ordinary skill in the art from the present disclosure how to implement them. Embodiments of the inventive system and method will be described with reference to FIGS. 2-4, 8-9, and 12.

Typical embodiments of the present invention are methods and systems which mix a horizontal B-format signal (consisting of signals W=SourceSig, X=cos θ×SourceSig, and Y=sin θ×SourceSig) into a matrix-encoded two-channel (stereo) signal pair (Lt, Rt). A matrix-encoded stereo signal pair (Lt, Rt) is determined by a source azimuth θ and gains $G_{Lt}$ and $G_{Rt}$ that obey Equations (1), (2), and (3) set forth above. The matrix-encoded stereo signal pair, Lt, Rt, generated in accordance with these embodiments possesses the following desirable properties:

the power of the stereo signal pair Lt, Rt, is independent of the source signal azimuth θ (and is determined only by the source magnitude, SourceSig); and the stereo signal pair Lt, Rt determined from a source signal with azimuth equal to zero (a front-center source signal) has no phase shift between the Lt and Rt channels.

In a class of embodiments, the inventive method generates a matrix-encoded stereo signal pair (Lt, Rt) in response to an input horizontal B-format signal (W, X, and Y) by performing a mixing operation defined simply in terms of a 2×3 matrix, M, and having form:

$$\begin{bmatrix} Lt \\ Rt \end{bmatrix} = M \times \begin{bmatrix} W \\ X \\ Y \end{bmatrix} \tag{10}$$

-continued $$\text{where, } M = \begin{bmatrix} \frac{1+j}{2\sqrt{2}} & \frac{1-j}{2\sqrt{2}} & \frac{1+j}{2\sqrt{2}} \\ \frac{1-j}{2\sqrt{2}} & \frac{1+j}{2\sqrt{2}} & \frac{-1+j}{2\sqrt{2}} \end{bmatrix} \tag{11}$$

The mixing operation of equations (10) and (11) thus has form:

$$\therefore \begin{bmatrix} Lt \\ Rt \end{bmatrix} = \begin{bmatrix} \frac{1+j}{2\sqrt{2}} & \frac{1-j}{2\sqrt{2}} & \frac{1+j}{2\sqrt{2}} \\ \frac{1-j}{2\sqrt{2}} & \frac{1+j}{2\sqrt{2}} & \frac{-1+j}{2\sqrt{2}} \end{bmatrix} \times \begin{bmatrix} W \\ X \\ Y \end{bmatrix} \tag{12}$$

Equations (10) and (12) assume that the input horizontal B-format signal has a single frequency component. In the typical case of an input horizontal B-format signal having multiple frequency components (i.e., the case that each of W, X, and Y has multiple frequency components), equations (10) and (12) determine for each of the frequency components having frequency, ω, a matrix-encoded stereo signal pair (Lt(ω), Rt(ω)), where Lt(ω) is a frequency component of a time domain representation of the matrix-encoded signal, Lt, and Rt(ω) is a frequency component of a time domain representation of the matrix-encoded signal, Rt, in response to the corresponding frequency components W(ω), X(ω), and Y(ω), of the input horizontal B-format signal.

In other embodiments, variants of the matrix defined in equation (11) are applied (in place of matrix M in equation (10) to produce a matrix-encoded Lt, Rt signal in response to an input horizontal B-format signal. For example, one such alternative matrix is the complex conjugate matrix:

$$M_c = \overline{M} = \begin{bmatrix} \frac{1-j}{2\sqrt{2}} & \frac{1+j}{2\sqrt{2}} & \frac{1-j}{2\sqrt{2}} \\ \frac{1+j}{2\sqrt{2}} & \frac{1-j}{2\sqrt{2}} & \frac{-1-j}{2\sqrt{2}} \end{bmatrix} \tag{13}$$

where said matrix $M_c$ is the matrix formed by taking the complex conjugate of each element of the matrix M. Also, either of the matrices defined in equations defined in equations (14) and (15) below, which are determined by applying an arbitrary complex phase shift to the matrices of equations (11) and (13), can be applied (in place of matrix M in equation (10)) to produce a matrix-encoded Lt, Rt signal in response to an input horizontal B-format signal:

$$M_\Psi = e^{j\Psi} \times M \tag{14}$$

$$M_{c,\Psi} = e^{j\Psi} \times \overline{M} \tag{15}$$

where Ψ is an arbitrary (real) phase shift. The phase shift Ψ can be a frequency dependent phase shift (e.g., as might occur if an all-pass filter were applied to the elements of the matrix M). In the case that the input horizontal B-format signal has multiple frequency components (i.e., each of W, X, and Y has multiple frequency components) and the phase shift Ψ is frequency dependent, equation (12) with the matrix defined in equation (14) or (15) replacing matrix M of equation (10), determines for each of the frequency components having frequency, ω, a matrix-encoded stereo signal pair (Lt(ω), Rt(ω)), where Lt(ω) is a frequency component of a time domain representation of the matrix-encoded signal, Lt, and Rt(ω) is a frequency component of a time domain representation of the matrix-encoded signal, Rt, in response to the corresponding frequency components W(ω), X(ω), and Y(ω), of the input horizontal B-format signal.

A preferred embodiment of the present invention implements the mixing operation having form set forth in equation (12). However, it is contemplated that some alternative embodiments employ a mixing matrix as defined in Equation (13), (14), or (15), in place of matrix M of equations (10) and (11), to generate valid matrix-encoded stereo signals.

Typically, the source audio signal represented by the horizontal B-format signal has a frequency domain representation including at least one frequency component, the horizontal B-format signal has frequency components W(ω), X(ω), and Y(ω) for each frequency component of the source audio signal having frequency, ω, and the inventive method includes a step of:

(a) for each frequency component of the source audio signal having frequency, ω, generating frequency components, Lt(ω), Rt(ω), of a matrix-encoded two-channel audio signal in response to the frequency components W(ω), X(ω), and Y(ω), of the horizontal B-format signal by performing a mixing operation having form $$\begin{bmatrix} Lt(\omega) \\ Rt(\omega) \end{bmatrix} = S \times \begin{bmatrix} W(\omega) \\ X(\omega) \\ Y(\omega) \end{bmatrix},$$

where $S = e^{j\Psi(\omega)} \times T$, Ψ(ω) is a real phase shift whose value depends on the frequency, ω, and T is a 2×3 matrix.

Preferably, the matrix T is selected is selected from the group consisting of $$M \text{ and } M_c = \overline{M},$$

$$\text{where } M = \begin{bmatrix} \frac{1+j}{2\sqrt{2}} & \frac{1-j}{2\sqrt{2}} & \frac{1+j}{2\sqrt{2}} \\ \frac{1-j}{2\sqrt{2}} & \frac{1+j}{2\sqrt{2}} & \frac{-1+j}{2\sqrt{2}} \end{bmatrix} \text{ and}$$

$$M_c = \overline{M} = \begin{bmatrix} \frac{1-j}{2\sqrt{2}} & \frac{1+j}{2\sqrt{2}} & \frac{1-j}{2\sqrt{2}} \\ \frac{1+j}{2\sqrt{2}} & \frac{1-j}{2\sqrt{2}} & \frac{-1-j}{2\sqrt{2}} \end{bmatrix}; \text{ and}$$

Typically, the matrix-encoded two-channel audio signal Lt, Rt, is a time domain, matrix-encoded two-channel audio signal, and the method also includes a step of:

performing a frequency-to-time domain transform on the frequency components Lt(ω), Rt(ω) generated in step (a) to determine the time domain, matrix-encoded two-channel audio signal.

In embodiments in which the horizontal B-format signal is indicative of a source audio signal having multiple frequency components, each trio of frequency components W(ω), X(ω), and Y(ω) of the horizontal B-format signal may be indicative of a component, SourceSig(ω), of the source audio signal, and the frequency components W(ω), X(ω), and Y(ω) of the horizontal B-format signal are W(ω)=SourceSig(ω), X(ω)=cos θ×SourceSig(ω), and Y(ω)=sin θ×SourceSig(ω).

In embodiments in which the horizontal B-format signal is indicative of a source audio signal having at least one frequency component, each frequency component having a different frequency, ω, and the horizontal B-format signal has frequency components W(ω), X(ω), and Y(ω) for each frequency component of the source audio signal, each frequency ω is typically measured in radians per second, the frequency components W(ω), X(ω), and Y(ω) are typically defined for only positive frequencies, and the complex gain values included in the matrix S(ω) are gains that apply to positive frequencies (ω>0). It is also within the scope of the invention for the frequency components W(ω), X(ω), and Y(ω) to be defined for positive and negative frequencies, and to apply in step (a) the matrix $S=e^{j\Psi(\omega)}\times T$ to the components W(ω), X(ω), and Y(ω) having positive frequency, and to apply in step (a) the complex conjugate of said matrix S to the components W(ω), X(ω), and Y(ω) having negative frequency. In general, for complex gain values, a gain of j (a+90 degree phase shift) corresponds to an inverse-Hilbert transform, which applies a gain of j to the positive frequencies of the signal, and a gain of −j to the negative frequencies of the signal. Thus, the complex gain values in the above-discussed matrix $S=e^{j\Psi(\omega)}\times T$ are applied only to positive frequencies of the signals being processed, but the complex conjugates of these values would be applied to the negative frequency components (if any) of the signals.

In general, with reference to the expression Y(ω)=G(ω)×X(ω), where Y and X are signals, and G is a frequency dependant gain, there some important points to note about the multiplication operation (x):

If x(t) is the original time-domain real signal and X(ω)=F{x(t)} is the Fourier transform of x(t), then X(ω) is a Hermitian function of w. Thus, the real part of X(ω) is an even function, and the imaginary part of X(ω) is an odd function (this is a consequence of x(t) being real);

In general, it is preferred to ensure that all frequency-dependent signal or gain functions are Hermitian functions (so that we can be assured that these frequency domain signal or gain functions correspond to real time domain functions). We already know that X(ω) is Hermitian, and if we force G(ω) to be Hermitian, this ensures that Y(ω) will also be Hermitian;

If Y(ω) is Hermitian, then we can be assured that the inverse Fourier transform: y(t)=InvF{Y(ω)} will be a real signal;

In practical DSP systems (e.g., those which implement typical embodiments of the invention), signals are often processed in the frequency domain, and in so doing, the Fourier components that correspond to negative frequencies w are typically discarded. The transform known as "Real FFT" does this automatically. The negative frequencies can be discarded because they can be regenerated at any time, if needed, by assuming that the overall frequency response was Hermitian, and therefore we can re-calculate X(−ω)=conjugate (X(ω)); and In the case of signal processing (performed in typical embodiments of the invention) using only the positive frequency components (e.g., from an FFT operation), it is convenient to state "multiply the signal by jk", where k is an arbitrary value, when this implicitly denotes multiplying the negative frequency components (if any) of the signal by the conjugate, which is −jk.

In another class of embodiments, a matrix-encoded two-channel (stereo) audio signal is generated by generating microphone output signals (by capturing sound with a microphone array), and performing a mixing operation on the microphone output signals, where the mixing operation is equivalent to generating a horizontal B-format signal in response to the microphone output signals, and generating the matrix-encoded two-channel audio signal, Lt, Rt, in response to the horizontal B-format signal in accordance with any embodiment of the inventive method. The microphone array is typically a small array of cardioid microphones (e.g., an array consisting of three cardiod microphones).

For example, the array of microphones may be implemented as an element of a teleconferencing (or audio/video conferencing) system. One such system would include an apparatus at each user location, with each such apparatus including a microphone array, and an encoder coupled and configured to generate a matrix-encoded two-channel audio signal in response to the output of the microphone array in accordance with an embodiment of the inventive method. The matrix-encoded two-channel audio signal would be transmitted (after optional subsequent processing) to each of the other user locations (e.g., for rendering by a headset or loudspeaker array, optionally after decoding and/or other processing).

In a subclass of embodiments in this class, the mixing operation includes steps of: generating the horizontal B-format signal in response to the microphone output signals; and generating the matrix-encoded two-channel audio signal, Lt, Rt, in response to the horizontal B-format signal in accordance with any embodiment of the inventive method.

In a second subclass of embodiments in this class, the microphone output signals are a set of n microphone signals, M1, . . . , Mn, and the mixing operation has form $$\begin{bmatrix} Lt \\ Rt \end{bmatrix} = S' \times \begin{bmatrix} M1 \\ \vdots \\ Mn \end{bmatrix},$$

where $S'=e^{j\Psi}\times T'$, Ψ is a real phase shift, and T' is a 2×n matrix.

In some embodiments in the second subclass, n=3, the microphone output signals are a left channel signal, L (having a frequency domain representation including at least one frequency component, L(ω), where ω denotes frequency), a right channel signal, R (having a frequency domain representation including at least one frequency component, R(ω)), and a surround (rear) channel signal, S (having a frequency domain representation including at least one frequency component, S(ω)), the matrix-encoded two-channel audio signal, Lt, Rt, has a frequency domain representation including at least one pair of frequency components, Lt(ω), Rt(ω), and the step of generating the matrix-encoded two-channel audio signal, Lt, Rt, includes a step of:

generating the frequency components Lt(ω), Rt(ω) in response to the frequency components L(ω), R(ω), and S(ω), by performing a mixing operation having form $$\begin{bmatrix} Lt(\omega) \\ Rt(\omega) \end{bmatrix} = S'(\omega) \times \begin{bmatrix} L(\omega) \\ R(\omega) \\ S(\omega) \end{bmatrix},$$

where $S'(\omega)=e^{j\Psi(\omega)}\times T'$, Ψ(ω) is a real phase shift whose value depends on the frequency, ω, and T' is a 2×3 matrix. Preferably, the matrix T' is selected from the group consisting of $$M \times \begin{bmatrix} 2/3 & 2/3 & 2/3 \\ 2/3 & 2/3 & -4/3 \\ 2/\sqrt{3} & -2\sqrt{3} & 0 \end{bmatrix} \text{ and}$$

$$M_c \times \begin{bmatrix} 2/3 & 2/3 & 2/3 \\ 2/3 & 2/3 & -4/3 \\ 2/\sqrt{3} & -2\sqrt{3} & 0 \end{bmatrix},$$

-continued $$\text{where } M = \begin{bmatrix} \frac{1+j}{2\sqrt{2}} & \frac{1-j}{2\sqrt{2}} & \frac{1+j}{2\sqrt{2}} \\ \frac{1-j}{2\sqrt{2}} & \frac{1+j}{2\sqrt{2}} & \frac{-1+j}{2\sqrt{2}} \end{bmatrix} \text{ and}$$

$$M_c = \overline{M} = \begin{bmatrix} \frac{1-j}{2\sqrt{2}} & \frac{1+j}{2\sqrt{2}} & \frac{1-j}{2\sqrt{2}} \\ \frac{1+j}{2\sqrt{2}} & \frac{1-j}{2\sqrt{2}} & \frac{-1-j}{2\sqrt{2}} \end{bmatrix}.$$

Figure 2:
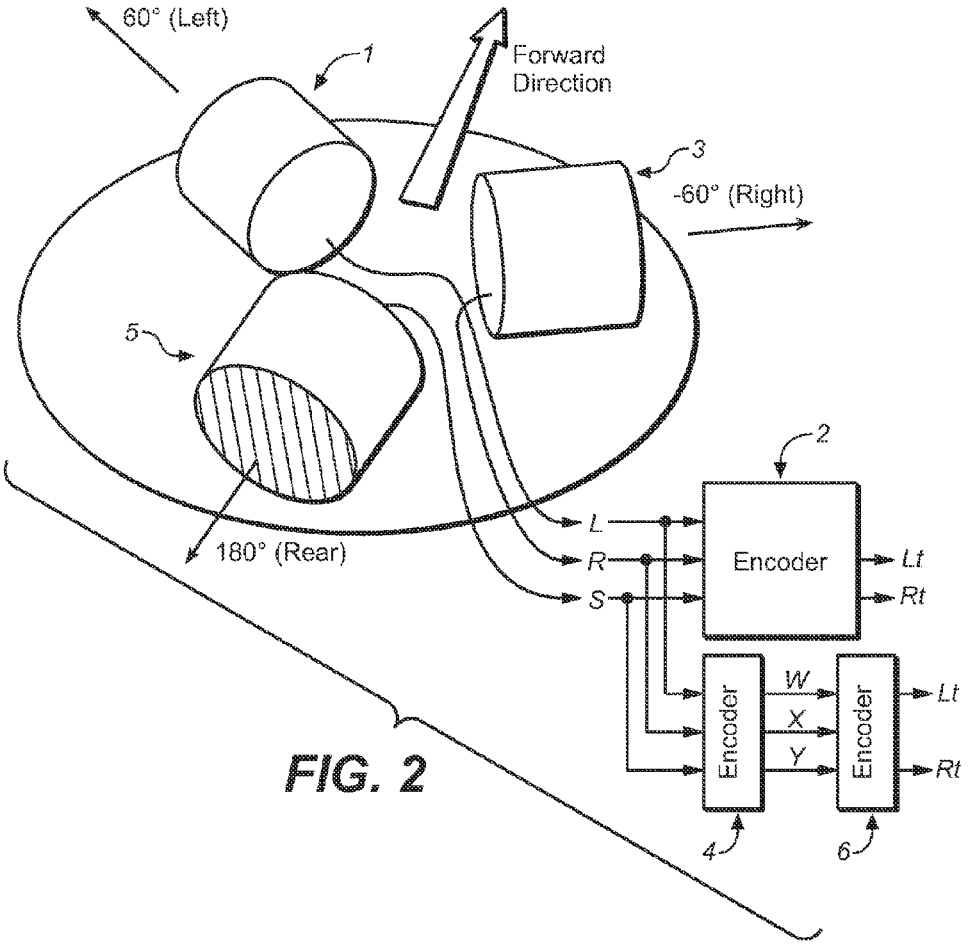
FIG. 2 is a block diagram of a system implementing an embodiment of the inventive method, including a microphone array and three encoders (2, 4, and 6). Encoder 6 is an embodiment of the invention and encoder 2 is another embodiment of the invention.

For example, the system of FIG. 2 includes a three capsule microphone array (comprising microphones 1, 3, and 5) coupled to each of encoders 2 and 4. Encoder 4 has inputs coupled to receive the three output signals (L, R, and S) of the microphone array, and is configured to mix the microphone output signals (L, R, and S) to generate a horizontal B-format signal (W, X, and Y). Encoder 2 is configured in accordance with any embodiment of the present invention (e.g., the embodiment described below with reference to equations (17) and (18) of FIG. 4) to generate a matrix-encoded stereo signal (Lt, Rt) in response to the microphone output signals (L, R, and S). Encoder 6 of FIG. 2 has inputs coupled to receive the three channels (W, X, and Y) of the horizontal B-format signal generated by encoder 4, and is configured in accordance with any embodiment of the present invention (e.g., the embodiment described with reference to equations (10) and (11), or an embodiment which employs the mixing matrix of equation (13), (14), or (15) in place of matrix M of equations (10) and (11)) to generate a matrix-encoded stereo signal (Lt, Rt) in response to the horizontal B-format signal.

The microphone array of FIG. 2 includes three microphones (sometimes referred to as capsules) 1, 3, and 5. In response to an audio signal from a source located in the forward direction (identified in FIG. 2), microphone 1 produces a left (L) output signal, microphone 3 produces a right (R) output signal, and microphone 5 produces a surround (S) output signal. Signals L, R, and S thus correspond to source azimuth angles of 60°, −60°, and 180°, respectively. Microphones 1, 3, and 5 can be implemented as simple cardiod microphones, so that the output signals L, R, and S are cardioid signals. Output signals L, R, and S can be converted to the W, X, and Y signals of a horizontal B-format signal via the matrix operation indicated in equation (16) shown in FIG. 3.

Thus, an embodiment of the invention employs a matrix transformation, as indicated in equation (17) shown in FIG. 4, which generates a matrix-encoded stereo signal (Lt, Rt) in response to the L, R, and S signals. Matrix F of equation (17) is defined by equation (18), also shown in FIG. 4.

Hence, matrix F of equation (17) provides a means for converting the three microphone signals output from microphones 1, 3, and 5 to the matrix-encoded stereo signal (Lt, Rt). As previously discussed, alternatives exist for the matrix M of equation (18). If any of these alternative matrices ($M_c$, $M_\Psi$, $M_{c,\Psi}$) are substituted in equation (18) in place of matrix M, then alternative versions of the matrix F are generated. These alternative versions of the matrix F, which are also useful to create viable Matrix encoded $L_t$, $R_t$ signals, are:

$$F_c = \overline{F}, \tag{19}$$

$$F_\Psi = e^{j\Psi} \times F, \text{ and} \tag{20}$$

$$F_{c,\Psi} = e^{j\Psi} \times \overline{F}, \tag{21}$$

where each element of $\overline{F}$ is the complex conjugate the corresponding element of F, and Ψ is an arbitrary (real) phase shift (or Ψ is a frequency dependent phase shift).

There are known methods for converting B-format signals to speaker signals for multi-channel playback, and there are also known methods for converting multi-channel speaker signals to matrix encoded signals. However, conventional B-format to speaker processing combined with conventional speaker to matrix-encode processing cannot create a viable matrix-encoded signal, Lt, Rt.

For example, an example of conventional decoding of a B-format signal to a format for driving multiple speakers (left channel L for driving a left speaker, right channel R for driving a right speaker, center channel C for driving a front, center speaker, and channel R for driving a rear speaker) is shown in equation (22), set forth as FIG. 5. This decoding can be implemented with a fairly simple decoder. Alternative conventional methods of this type exist that may have slightly different values in the matrix than those shown in equation (22).

An example of conventional encoding of multiple speaker feeds such as those generated in accordance with equation (22) to create a stereo signal pair, Lt, Rt, is shown in equation (23), set forth as FIG. 6. This is commonly done using the well known Dolby Pro Logic encoder.

By combining together the conventional methods of equations (22) and (23), one can produce stereo signal pair, Lt, Rt, in response to a B-format signal as shown in equation (24), set forth as FIG. 7.

We can validate the effectiveness of the method represented by equation (24) for generating a matrix encoded two-channel audio signal (i.e., to assess whether the Lt and Rt signals generated by this method are a matrix encoded two-channel audio signal) by considering the amplitude of the Lt and Rt signals generated by the equation (24) method, and the relative phase difference between them as a function of azimuth θ. FIGS. 8 and 9 show the magnitude and phase characteristics of the embodiment of the inventive matrix encoding method represented by equation (10) above, which employs matrix M set forth in equation (10). FIGS. 10 and 11 show the magnitude and phase characteristics of the conventional method represented by equation (24).

In FIG. 8, the power of the Lt signal generated by the inventive method of equation (10) is shown as a function of azimuth θ by the solid curve, the power of the Rt signal generated by this method is shown as a function of azimuth θ by the dashed curve, and the total power of these Lt and Rt signals is shown as a function of azimuth θ by the dotted curve. FIG. 9 shows the phase difference between the Lt and Rt signals of FIG. 8 as a function of the azimuth θ.

In FIG. 10, the power of the Lt signal generated by the conventional method of equation (24) is shown as a function of azimuth θ by the solid curve, the power of the Rt signal generated by this method is shown as a function of azimuth θ by the dashed curve, and the total power of these Lt and Rt signals is shown as a function of azimuth θ by the dotted curve. FIG. 11 shows the phase difference between the Lt and Rt signals of FIG. 10 as a function of the azimuth θ.

As apparent from FIG. 10, the total power of the Lt and Rt signals generated by the conventional method of equation (24) is not constant as a function of azimuth θ. In contrast, FIG. 8 (i.e., the dotted curve at the top) shows that the total power of the Lt and Rt signals generated by the inventive method of equation (10) is constant as a function of azimuth θ.

FIG. 9 shows that the phase difference between the Lt and Rt signals generated by the inventive method of equation (10)

is 0° or 180° over all values of azimuth θ. This is the desired 0°/180° phase characteristic that a matrix-encoded signal pair should typically exhibit. In contrast, FIG. 11 shows that the conventional method of equation (24) does not produce the desired 0°/180° phase characteristic that a matrix-encoded signal pair should typically exhibit.

Figure 12:
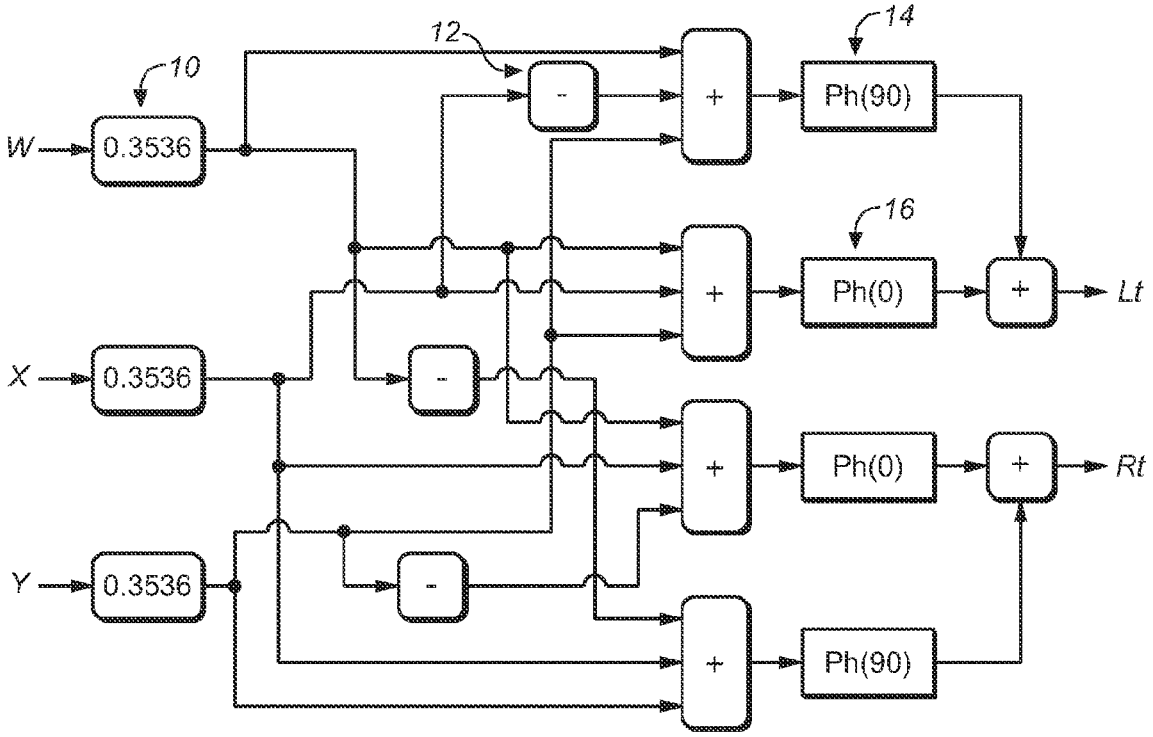
FIG. 12 is a block diagram of a system configured to perform an embodiment of the inventive method by implementing a mixing operation having form as set forth in equation (12).

FIG. 12 is a block diagram of a system configured to perform an embodiment of the inventive method by implementing a mixing operation having form as set forth in equation (12). The system of FIG. 12 includes the following signal processing components: gain block 10 which is configured to scale each of the input signals W, X, and Y by 0.3536; block 12 (coupled to block 10) which is configured to invert the outputs of block 10 (the scaled signals W, X, and Y) and to add the indicated combinations of the scaled signals W, X, and Y and the inverted, scaled signals W, X, and Y; and a final (phase shift and summing) stage. In the final stage, each block labeled "Ph(90)" is configured to apply a 90 degree phase shift to its input (one of the Ph(90) blocks is also identified in FIG. 12 by the reference numeral 14), and is typically implemented as an FIR filter (possibly implemented using frequency domain convolution methods). In the final stage, each block labeled "Ph(0)" (one of the Ph(0) blocks is also identified in FIG. 12 by the reference numeral 16) is configured to provide an all-pass delay compensation, so that the effect of each Ph(90) block is to provide a transfer function that includes a 90-degree phase shift, relative to the transfer function of each Ph(0) block. This is a common method, known to those of ordinary skill in the art, whereby a 90-degree phase shift in one channel will incur some group-delay, so that a "non-phase shifted" channel will require some added delay (provided, in the FIG. 12 embodiment, by the Ph(0) blocks) to match the delay resulting from the 90-degree phase shift. In the final stage, the outputs of blocks 14 and 16 is summed to generate the output signal, Lt, and the outputs of the other two Ph(0) and Ph(90) blocks is summed to generate the output signal, Rt, as shown.

Other aspects of the invention include a system (e.g., the system of FIG. 2 or 12, or encoder 2 of FIG. 2, or encoder 6 of FIG. 2) configured (e.g., programmed) to perform any embodiment of the inventive method, and a computer readable medium (e.g., a disc) which stores code for programming a processor or other system to perform any embodiment of the inventive method.

In some embodiments, the inventive system is an encoder (e.g., encoder 2 or encoder 6 of FIG. 2) which is or includes a digital signal processor (DSP) configured to perform an embodiment of the inventive method. The DSP should have an architecture suitable for processing the expected input data (e.g., audio samples) and be configured (e.g., programmed) with appropriate firmware and/or software to implement an embodiment of the inventive method. The DSP could be implemented as an integrated circuit (or chip set) and would include program and data memory accessible by its processor(s). Alternatively, the inventive system is an encoder (e.g., encoder 2 or encoder 6 of FIG. 2) which is implemented as a general or special purpose processor programmed with appropriate software (or firmware) and/or is otherwise configured to perform an embodiment of the inventive method, or is implemented in hardware configured to perform an embodiment of the inventive method. In some embodiments, the inventive system (e.g., encoder) includes a sampling stage coupled to receive input audio and configured to generate data (samples of the input audio) suitable for processing in accordance with an embodiment of the inventive method. For example, encoder 2 (or encoder 4) of FIG. 2 may be implemented to include such a sampling stage for sampling the output of microphones 1, 3, and 5 (when the output of microphones 1, 3, and 5 is not already a stream of samples suitable for processing in accordance with an embodiment of the inventive method), and a processing stage configured to perform an embodiment of the inventive method in response to audio samples asserted thereto from the sampling stage.

While specific embodiments of the present invention and applications of the invention have been described herein, it will be apparent to those of ordinary skill in the art that many variations on the embodiments and applications described herein are possible without departing from the scope of the invention described and claimed herein. It should be understood that while certain forms of the invention have been shown and described, the invention is not to be limited to the specific embodiments described and shown or the specific methods described.

The invention claimed is:

1. A method for generating a matrix-encoded two-channel audio signal, Lt, Rt, in response to a horizontal B-format signal comprising signals W =SourceSig, X=cos θ×SourceSig, and Y=sin θ×SourceSig, where SourceSig is the waveform of a source audio signal and θ is the azimuth of the source audio signal, said method including a step of:

(a) performing on the horizontal B-format signal a mixing operation having form $$\begin{bmatrix} Lt \\ Rt \end{bmatrix} = S \times \begin{bmatrix} W \\ X \\ Y \end{bmatrix},$$

where $S=e^{j\Psi}\times T$, Ψ is a real phase shift, where T is a 2×3 matrix and wherein the matrix T is selected from the group consisting of M and $M_c=\overline{M}$, where $$M = \begin{bmatrix} \frac{1+j}{2\sqrt{2}} & \frac{1-j}{2\sqrt{2}} & \frac{1+j}{2\sqrt{2}} \\ \frac{1-j}{2\sqrt{2}} & \frac{1+j}{2\sqrt{2}} & \frac{-1+j}{2\sqrt{2}} \end{bmatrix} \text{ and}$$

$$M_c = \overline{M} = \begin{bmatrix} \frac{1-j}{2\sqrt{2}} & \frac{1+j}{2\sqrt{2}} & \frac{1-j}{2\sqrt{2}} \\ \frac{1+j}{2\sqrt{2}} & \frac{1-j}{2\sqrt{2}} & \frac{-1-j}{2\sqrt{2}} \end{bmatrix}.$$

2. The method of claim 1, wherein the source audio signal has a frequency domain representation including at least one frequency component, each said frequency component having a different frequency, ω, the horizontal B-format signal has frequency components W(ω), X(ω), and Y(ω) for each frequency component of the source audio signal, and step (a) includes the step of:

for each said frequency component of the source audio signal, generating frequency components, Lt(ω), Rt(ω), of the matrix-encoded two-channel audio signal in response to the frequency components W(ω), X(ω), and Y(ω), of the horizontal B-format signal by performing a mixing operation having form $$\begin{bmatrix} Lt(\omega) \\ Rt(\omega) \end{bmatrix} = S(\omega) \times \begin{bmatrix} W(\omega) \\ X(\omega) \\ Y(\omega) \end{bmatrix},$$

where $S(\omega)=e^{j\Psi(\omega)}\times T$, and $\Psi(\omega)$ is a real phase shift whose value depends on the frequency, ω.

3. The method of claim 2, wherein the matrix-encoded two-channel audio signal Lt, Rt, is a time domain, matrix-encoded two-channel audio signal, and the method also includes a step of:

(b) performing a frequency-to-time domain transform on the frequency components Lt(ω), Rt(ω) generated in step (a) to determine said time domain, matrix-encoded two-channel audio signal.

4. The method of claim 2, wherein each set of three frequency components W(ω), X(ω), and Y(ω) of the horizontal B-format signal is indicative of a frequency component, SourceSig(ω), of the source audio signal, and each said set of three frequency components W(ω), X(ω), and Y(ω) is W(ω)=SourceSig(ω), X(ω)=cos θ×SourceSig(ω), and Y(ω)=sin θ×SourceSig(ω).

5. The method of claim 1, further including the steps of:

generating microphone output signals by capturing sound with a microphone array; and generating the horizontal B-format signal in response to the microphone output signals.

6. The method of claim 5, wherein the source audio signal has a frequency domain representation including at least one frequency component, each said frequency component having a different frequency, ω, the horizontal B-format signal has frequency components W(ω), X(ω), and Y(ω) for each frequency component of the source audio signal, and generating the matrix-encoded two-channel audio signal, Lt, Rt, in response to the horizontal B-format signal includes a step of:

for each said frequency component of the source audio signal, generating frequency components, Lt(ω), Rt(ω), of the matrix-encoded two-channel audio signal in response to the frequency components W(ω), X(ω), and Y(ω), of the horizontal B-format signal by performing a mixing operation having form $$\begin{bmatrix} Lt(\omega) \\ Rt(\omega) \end{bmatrix} = S(\omega) \times \begin{bmatrix} W(\omega) \\ X(\omega) \\ Y(\omega) \end{bmatrix},$$

where $S(\omega)=e^{j\Psi(\omega)}\times T$, and $\Psi(\omega)$ is a real phase shift whose value depends on the frequency, ω.

7. The method of claim 6, wherein the matrix-encoded two-channel audio signal Lt, Rt, is a time domain, matrix-encoded two-channel audio signal, and the method also includes a step of:

performing a frequency-to-time domain transform on the generated frequency components Lt(ω), Rt(ω) to determine said time domain, matrix-encoded two-channel audio signal.

8. A method for generating a matrix-encoded two-channel audio signal, Lt, Rt, including the steps of:

generating microphone output signals by capturing sound with a microphone array, wherein the microphone output signals are a set of n microphone signals; wherein n=3, and wherein the microphone output signals are a left channel signal, L, a right channel signal, R, and a surround channel signal, S and generating the matrix-encoded two-channel audio signal, Lt, Rt, in response to the microphone output signals including by performing a mixing operation on said microphone output signals, said mixing operation having form $$\begin{bmatrix} Lt \\ Rt \end{bmatrix} = S' \times \begin{bmatrix} L \\ R \\ S \end{bmatrix},$$

where $S'=e^{j\Psi}\times T'$, Ψis a real phase shift, where T' is a 2×n matrix, and wherein the matrix T' is selected from the group consisting of $$M \times \begin{bmatrix} 2/3 & 2/3 & 2/3 \\ 2/3 & 2/3 & -4/3 \\ 2/\sqrt{3} & -2\sqrt{3} & 0 \end{bmatrix} \text{ and}$$

$$M_c \times \begin{bmatrix} 2/3 & 2/3 & 2/3 \\ 2/3 & 2/3 & -4/3 \\ 2/\sqrt{3} & -2\sqrt{3} & 0 \end{bmatrix}, \text{ where}$$

$$M = \begin{bmatrix} \frac{1+j}{2\sqrt{2}} & \frac{1-j}{2\sqrt{2}} & \frac{1+j}{2\sqrt{2}} \\ \frac{1-j}{2\sqrt{2}} & \frac{1+j}{2\sqrt{2}} & \frac{-1+j}{2\sqrt{2}} \end{bmatrix} \text{ and}$$

$$M_c = \overline{M} = \begin{bmatrix} \frac{1-j}{2\sqrt{2}} & \frac{1+j}{2\sqrt{2}} & \frac{1-j}{2\sqrt{2}} \\ \frac{1+j}{2\sqrt{2}} & \frac{1-j}{2\sqrt{2}} & \frac{-1-j}{2\sqrt{2}} \end{bmatrix}.$$

9. The method of claim 8, wherein the left channel signal, L, has a frequency domain representation including at least one frequency component, L(ω), where ωdenotes frequency, the right channel signal, R, has a frequency domain representation including at least one frequency component, R(ω), and the surround channel signal, S, has a frequency domain representation including at least one frequency component, S(ω), the matrix-encoded two-channel audio signal, Lt, Rt, has a frequency domain representation including at least one pair of frequency components, Lt(ω), Rt(ω), and the step of generating the matrix-encoded two-channel audio signal, Lt, Rt, includes a step of:

generating the frequency components Lt(ω), Rt(ω) in response to the frequency components L(ω), R(ω), and S(ω), by performing a mixing operation having form $$\begin{bmatrix} Lt(\omega) \\ Rt(\omega) \end{bmatrix} = S'(\omega) \times \begin{bmatrix} L(\omega) \\ R(\omega) \\ S(\omega) \end{bmatrix},$$

where $S'(\omega)=e^{j\Psi\omega}\times T'$, Ψ(ω) is a real phase shift whose value depends on the frequency, ω.

10. The method of claim 9, wherein the matrix-encoded two-channel audio signal Lt, Rt, is a time domain, matrix-encoded two-channel audio signal, and the step of generating the matrix-encoded two-channel audio signal, Lt, Rt, also includes a step of:

performing a frequency-to-time domain transform on the generated frequency components Lt(ω), Rt(ω) to determine the time domain, matrix-encoded two-channel audio signal.

11. A system configured to generate a matrix-encoded two-channel audio signal, Lt, Rt, in response to a horizontal B-format signal comprising signals W=SourceSig, X=cos θ×SourceSig, and Y=sin θ×SourceSig, where SourceSig is the waveform of a source audio signal and θ is the azimuth of the source audio signal, said system including:

at least one input coupled to receive the horizontal B-format signal; and a subsystem configured to perform on the horizontal B-format signal a mixing operation having form $$\begin{bmatrix} Lt \\ Rt \end{bmatrix} = S \times \begin{bmatrix} W \\ X \\ Y \end{bmatrix},$$

where $S=e^{j\Psi\omega}\times T$, Ψ is a real phase shift, where T is a 2×3 matrix, and wherein the matrix T is selected from the group consisting of M and $M_c=\overline{M}$, where $$M = \begin{bmatrix} \frac{1+j}{2\sqrt{2}} & \frac{1-j}{2\sqrt{2}} & \frac{1+j}{2\sqrt{2}} \\ \frac{1-j}{2\sqrt{2}} & \frac{1+j}{2\sqrt{2}} & \frac{-1+j}{2\sqrt{2}} \end{bmatrix} \text{ and}$$

$$M_c = \overline{M} = \begin{bmatrix} \frac{1-j}{2\sqrt{2}} & \frac{1+j}{2\sqrt{2}} & \frac{1-j}{2\sqrt{2}} \\ \frac{1+j}{2\sqrt{2}} & \frac{1-j}{2\sqrt{2}} & \frac{-1-j}{2\sqrt{2}} \end{bmatrix}.$$

12. The system of claim 11, wherein the source audio signal has a frequency domain representation including at least one frequency component, each said frequency component having a different frequency, ω, the horizontal B-format signal has frequency components W(ω), X(ω), and Y(ω) for each frequency component of the source audio signal, and the subsystem is configured to perform an operation of:

for each said frequency component of the source audio signal, generating frequency components, Lt(ω), Rt(ω), of the matrix-encoded two-channel audio signal in response to the frequency components W(ω), X(ω), and Y(ω), of the horizontal B-format signal by performing a mixing operation having form $$\begin{bmatrix} Lt(\omega) \\ Rt(\omega) \end{bmatrix} = S(\omega) \times \begin{bmatrix} W(\omega) \\ X(\omega) \\ Y(\omega) \end{bmatrix},$$

where $S(\omega)=e^{j\Psi(\omega)}\times T$, and Ψ(ω) is a real phase shift whose value depends on the frequency, ω.

13. The system of claim 12, wherein the matrix-encoded two-channel audio signal Lt, Rt, is a time domain, matrix-encoded two-channel audio signal, and the subsystem is also configured to perform a frequency-to-time domain transform on the generated frequency components Lt(ω), Rt(ω) to determine said time domain, matrix-encoded two-channel audio signal.

14. The system of claim 12, wherein each set of three frequency components W(ω), X(ω), and Y(ω) of the horizontal B-format signal is indicative of a frequency component, SourceSig(ω), of the source audio signal, and each said set of three frequency components W(ω), X(ω), and Y(ω) is W(ω)=SourceSig(ω), X(ω)=cos θ×SourceSig(ω), and Y(ω)=sin θ×SourceSig(ω).

15. The system of claim 11, further including:

a microphone array configured to generate microphone output signals by capturing sound; and a second subsystem coupled to the microphone array and to the at least one input, wherein the second subsystem is configured to generate the horizontal B-format signal in response to the microphone output signal and to provide the horizontal B-format signal to the at least one input.

16. The system of claim 15, wherein the microphone array is an array of cardioid microphones.

17. A system configured to generate a matrix-encoded two-channel audio signal, Lt, Rt, said system including:

a microphone array configured to generate microphone output signals by capturing sound, wherein the microphone output signals are a set of n microphone signals; wherein n=3, and the microphone output signals are a left channel signal, L, a right channel signal, R, and a surround channel signal, S; and a subsystem coupled and configured to generate the matrix-encoded two-channel audio signal, Lt, Rt, in response to the microphone output signals including by performing a mixing operation on said microphone output signals, said mixing operation having form $$\begin{bmatrix} Lt \\ Rt \end{bmatrix} = S' \times \begin{bmatrix} L \\ R \\ S \end{bmatrix},$$

where $S'=e^{j\Psi}\times T'$, Ψ is a real phase shift, where T' is a 2×n matrix, and wherein the matrix T' is selected from the group consisting of $$M \times \begin{bmatrix} 2/3 & 2/3 & 2/3 \\ 2/3 & 2/3 & -4/3 \\ 2/\sqrt{3} & -2\sqrt{3} & 0 \end{bmatrix} \text{ and}$$

$$M_c \times \begin{bmatrix} 2/3 & 2/3 & 2/3 \\ 2/3 & 2/3 & -4/3 \\ 2/\sqrt{3} & -2\sqrt{3} & 0 \end{bmatrix}, \text{ where}$$

$$M = \begin{bmatrix} \frac{1+j}{2\sqrt{2}} & \frac{1-j}{2\sqrt{2}} & \frac{1+j}{2\sqrt{2}} \\ \frac{1-j}{2\sqrt{2}} & \frac{1+j}{2\sqrt{2}} & \frac{-1+j}{2\sqrt{2}} \end{bmatrix} \text{ and}$$

$$M_c = \overline{M} = \begin{bmatrix} \frac{1-j}{2\sqrt{2}} & \frac{1+j}{2\sqrt{2}} & \frac{1-j}{2\sqrt{2}} \\ \frac{1+j}{2\sqrt{2}} & \frac{1-j}{2\sqrt{2}} & \frac{-1-j}{2\sqrt{2}} \end{bmatrix}.$$

18. The system of claim 17, wherein the microphone array is an array of cardioid microphones.

19. The system of claim 17, wherein the left channel signal, L, has a frequency domain representation including at least one frequency component, L(ω), where ω denotes frequency, the right channel signal, R, has a frequency domain representation including at least one frequency component, R(ω), and the surround channel signal, S, has a frequency domain representation including at least one frequency component, S(ω), the matrix-encoded two-channel audio signal, Lt, Rt, has a frequency domain representation including at least one pair of frequency components, Lt(ω), Rt(ω), and the subsystem is configured to generate the matrix-encoded two-channel audio signal, Lt, Rt, including by:

generating the frequency components Lt(ω), Rt(ω) in response to the frequency components L(ω), R(ω), and S(ω), by performing a mixing operation having form $$\begin{bmatrix} Lt(\omega) \\ Rt(\omega) \end{bmatrix} = S'(\omega) \times \begin{bmatrix} L(\omega) \\ R(\omega) \\ S(\omega) \end{bmatrix},$$

where $S'(\omega)=e^{j\Psi(\omega)}\times T'$, $\Psi(\omega)$ is a real phase shift whose value depends on the frequency, ω.

20. The system of claim 19, wherein the matrix-encoded two-channel audio signal Lt, Rt, is a time domain, matrix-encoded two-channel audio signal, and the subsystem is configured to generate the matrix-encoded two-channel audio signal, Lt, Rt, including by:

performing a frequency-to-time domain transform on the generated frequency components Lt(ω), Rt(ω) to determine the time domain, matrix-encoded two-channel audio signal.

* * * * *